US011280113B2

(12) United States Patent
Yen et al.

(10) Patent No.: US 11,280,113 B2
(45) Date of Patent: Mar. 22, 2022

(54) TRANSMISSION STRUCTURE FOR ELECTRONIC LOCK

(71) Applicant: TLHM Co., LTD, Chiayi (TW)

(72) Inventors: Chia-Hung Yen, Chiayi (TW); Po-Yang Chen, Chiayi (TW)

(73) Assignee: TLHM Co., LTD, Chiayi (TW)

( * ) Notice: Subject to any disclaimer, the term of this patent is extended or adjusted under 35 U.S.C. 154(b) by 420 days.

(21) Appl. No.: 16/568,357

(22) Filed: Sep. 12, 2019

(65) Prior Publication Data

US 2020/0332559 A1 Oct. 22, 2020

(30) Foreign Application Priority Data

Apr. 18, 2019 (TW) ..... 108204769

(51) Int. Cl.
*E05B 47/00* (2006.01)

(52) U.S. Cl.
CPC .... *E05B 47/0012* (2013.01); *E05B 2047/002* (2013.01); *E05B 2047/0017* (2013.01); *E05B 2047/0024* (2013.01)

(58) Field of Classification Search
CPC ..... E05B 47/0012; E05B 2047/0017; E05B 2047/002; E05B 2047/0024; E05B 2047/0031; E05B 47/02; E05B 2047/0091
USPC ..... 70/280–282, 188–190, 149, 472, 218, 70/222, 223, 277, 278.1–278.3, 278.7, 70/279.1, 283.1, 422; 292/142, 144, 292/DIG. 27
See application file for complete search history.

(56) References Cited

U.S. PATENT DOCUMENTS 6,832,500 B1 * 12/2004 Chen ..... E05B 47/0012 292/144
8,365,561 B2 * 2/2013 Chang ..... E05B 47/026 70/472
8,490,445 B2 * 7/2013 Chiou ..... E05B 47/0012 70/279.1
8,621,900 B2 * 1/2014 Wu ..... E05B 47/026 70/280
2003/0071471 A1 * 4/2003 Lu ..... E05B 47/0012 292/144
2009/0173120 A1 * 7/2009 Lin ..... E05B 17/0058 70/279.1
2011/0185554 A1 * 8/2011 Huang ..... B23P 11/00 29/428

(Continued)

*Primary Examiner* — Lloyd A Gall
(74) *Attorney, Agent, or Firm* — Amin, Turocy & Watson, LLP

(57) ABSTRACT

A transmission structure includes: a turn button; a driven wheel including a wheel body and connecting parts having free ends or pushing blocks; and an actuating member including abutting parts corresponding to the free ends or the pushing blocks. When the driven wheel rotates, each of the free ends or each of the pushing blocks abuts against a corresponding one of the abutting parts. Also, the actuating member moves with a rotating shaft, and a latch connected to the rotating shaft displaces between a locked position and an unlocked position. When the driven wheel rotates, the latch does not displace and the actuating member cannot rotate. Also, each of the free ends or pushing blocks is still abutted by the corresponding one of the abutting parts and is curved elastically or deformed until the free end or the pushing block spans across the corresponding one of the abutting parts.

17 Claims, 13 Drawing Sheets

(56) References Cited

U.S. PATENT DOCUMENTS

| | | | | |
|---|---|---|---|---|
| 2013/0167598 | A1* | 7/2013 | Huang | F16H 19/02 70/278.1 |
| 2015/0308157 | A1* | 10/2015 | Lin | E05B 47/026 292/144 |
| 2017/0211295 | A1* | 7/2017 | Lin | E05B 47/0012 |
| 2021/0062547 | A1* | 3/2021 | Chen | E05B 9/02 |

* cited by examiner

TRANSMISSION STRUCTURE FOR ELECTRONIC LOCK

BACKGROUND

1. Technical Field

The present disclosure relates to electronic locks, and, more particularly, to a transmission structure for an electronic lock.

2. Description of the Prior Art

In order to keep home save, people will install a door lock on doors to prevent thieves from entering. The evolution of door locks has changed dramatically. In addition to a traditional door lock that is unlocked or locked by a key, there is also an electronic lock, such as a magnetic buckle induction lock or a password input lock. The electronic lock can automatically lock or unlock the latch via mechanical structures.

In the electronic lock according to the prior art, a motor drives gears through a worm, and drives a latch to unlock or lock a door lock. However, the latch, if being abnormal during a telescoping process (e.g. the latch is blocked during telescoping), may cause locked or unlocked failure. The abnormal latch can cause the transmission components in the electronic lock to be hooked to one another, and the failure cannot be eliminated manually. Only the professionals can dismantle the electronic lock and solve the problem of the abnormal latch. When the latch cannot displace to a locked position or an unlocked position, the motor will keep on rotating. Since the transmission components are hooked to one another, if the abnormal latch is not repaired immediately, the motor will keep on rotating and is likely to be damaged, and the lifespan of the electronic lock will be adversely affected.

Therefore, it is an urgent issue for a person having ordinary skill in the art to provide a transmission mechanism for an electronic lock that prevents the transmission components from being hooked to one another when the latch cannot displace, ensures that the lock can be locked or unlocked manually, protects the motor and increases the lifespan of the electronic lock.

SUMMARY

In view of the problems of the prior art, the present disclosure provides a transmission structure for an electronic lock, comprising: a turn button having a rotating shaft; a driven wheel rotatably, axially disposed on the rotating shaft and including a wheel body and a plurality of connecting parts disposed in the wheel body, each of the connecting parts having one end fixed to an inner wall of the wheel body and the other end formed as a free end; and an actuating member axially disposed on the rotating shaft and including a cam, a pressing block disposed on the cam, and a plurality of abutting parts disposed on a circumference surface of the cam, wherein when the driven wheel is driven by a power to rotate, each of the free ends abuts against a corresponding one of the abutting parts, the actuating member moves with the rotating shaft, and a latch connected to the rotating shaft displaces between an unlocked position and a locked position, and wherein when the driven wheel is driven by a power to rotate, the latch does not displace and the actuating member cannot rotate, each of the free ends is still abutted by the corresponding one of the abutting parts and each of the connecting parts is curved elastically until the free end spans across the corresponding one of the abutting parts.

In an embodiment, the driven wheel further comprises a coil rotatably, axially disposed on the rotating shaft and a plurality of supporting members, each of the supporting members having two ends connected to an outer side of the coil and the inner wall of the wheel body, respectively.

In an embodiment, the transmission structure further comprises: a switching device corresponding in position to the pressing block and configured for sensing a position changing of the pressing block; and a driving device electrically connected to the switching device and configured for providing the power to rotate the driven wheel based on the position changing of the pressing block.

In an embodiment, the pressing block comprises a first protrusion, a second protrusion, and a third protrusion, the switching device comprises a first switch and a second switch corresponding to the first protrusion and the second protrusion, respectively, and senses a first relative position of the first protrusion and the first switch and a second relative position of the second protrusion and the second switch, the driving device rotates the driven wheel based on the first relative position and the second relative position, and the third protrusion is disposed on a side of the first protrusion opposing the second protrusion or on a side of the second protrusion opposing the first protrusion.

In an embodiment, the driving device comprises a motor, a worm connected to the motor, and a driving wheel having a gear wheel and a pinion engaged with the worm and the wheel body, respectively, and when the motor is actuated, the worm drives the driving wheel to rotate the driven wheel.

In an embodiment, each of the connecting parts is disposed along a radial direction of the wheel body.

In an embodiment, the transmission structure is applicable to a lock set that is locked or unlocked by a key and has a driven plate extending toward the rotating shaft, penetrating the latch, connected to an extension part of the rotating shaft, and configured for moving the latch and the turn button when the key locks or unlocks the lock set.

In an embodiment, the transmission structure further comprises a housing configured for receiving the driving device, the driven wheel, the actuating member and the switching device.

The present disclosure further provides a transmission structure for an electronic lock, comprising: a turn button having a rotating shaft; a driven wheel rotatably, axially disposed on the rotating shaft and including a wheel body and a plurality of connecting parts disposed in the wheel body, each of the connecting parts having two ends fixed to an inner wall of the wheel body, a pushing block, and at least one elastic structure; and an actuating member axially disposed on the rotating shaft and including a cam, a pressing block disposed on the cam, and a plurality of abutting parts disposed on a circumference surface of the cam, wherein when the driven wheel is driven by a power to rotate, each of the pushing blocks abuts against a corresponding one of the abutting parts, the actuating member moves with the rotating shaft, and a latch connected to the rotating shaft displaces between an unlocked position and a locked position, and wherein when the driven wheel is driven by a power to rotate, the latch does not displace and the actuating member cannot rotate, each of the pushing blocks is still abutted by the corresponding one of the abutting parts and the at least one elastic structure is deformed until the pushing blocks span across the corresponding one of the abutting parts.

In an embodiment, the at least one elastic structure is U-shaped.

In an embodiment, the plurality of connecting parts form a triangular structure.

In an embodiment, the driven wheel further includes a coil rotatably, axially disposed on the rotating shaft and a plurality of supporting members, each of the supporting members having two ends connected to an outer side of the coil and an inner wall of the wheel body, respectively.

In an embodiment, the transmission structure further comprises: a switching device corresponding in position to the pressing block and configured for sensing a position changing of the pressing block; and a driving device electrically connected to the switching device and configured for providing the power to rotate the driven wheel based on the position changing of the pressing block.

In an embodiment, the pressing block comprises a first protrusion, a second protrusion, and a third protrusion, the switching device comprises a first switch and a second switch corresponding to the first protrusion and the second protrusion, respectively, and senses a first relative position of the first protrusion and the first switch and a second relative position of the second protrusion and the second switch, the driving device rotates the driven wheel based on the first relative position and the second relative position, and the third protrusion is disposed on a side of the first protrusion opposing the second protrusion or on a side of the second protrusion opposing the first protrusion.

In an embodiment, the driving device comprises a motor, a worm connected to the motor, and a driving wheel having a gear wheel and a pinion engaged with the worm and the wheel body, respectively, and when the motor is actuated, the worm drives the driving wheel to rotate the driven wheel.

In an embodiment, the transmission structure further comprises a housing configured for receiving the driving device, the driven wheel, the actuating member and the switching device.

In an embodiment, the transmission structure is applicable to a lock set that is locked or unlocked by a key and has a driven plate extending toward the rotating shaft, penetrating the latch, connected to an extension part of the rotating shaft, and configured for moving the latch and the turn button when the key locks or unlocks the lock set.

It is known from the above that in the transmission structure for an electronic lock according to the present disclosure, the driven wheel moves with the free ends or the pushing blocks of the connecting parts abutted against the abutting parts of the actuating member to drive the actuating member and to drive the rotating shaft and the latch that move with the actuating member. According to the present disclosure, the connecting parts are elastic, and the free ends or the pushing blocks can span across the abutting parts and keep on rotating idly when the latch cannot displace. Therefore, the problem that the driven wheel is hooked with the actuating member while the motor is still operating can be solved. A user can then rotate the turn button manually to open the door or turn the actuating member by using a key to move the latch for unlocking, and eliminate the failure after the door is unlocked.

BRIEF DESCRIPTION OF THE DRAWINGS

The disclosure can be more fully understood by reading the following detailed description of the embodiments, with reference made to the accompanying drawings, wherein.

DETAILED DESCRIPTION

The following illustrative embodiments are provided to illustrate the disclosure of the present disclosure, these and other advantages and effects can be apparently understood by those in the art after reading the disclosure of this specification.

It should be appreciated that the structures, proportions, size and the like of the figures in the present application are intended to be used in conjunction with the disclosure of the specification. They are not intended to limit the disclosure and therefore do not represent any substantial technical meanings. As used herein, the terminologies, such as "over," "a," and the like, are used to distinguish one element from another, and are not intended to limit the scope of the present application. The details of the specification may be on the basis of different points and applications, and numerous modifications and variations can be devised without departing from the spirit of the present disclosure.

Figure 1A:
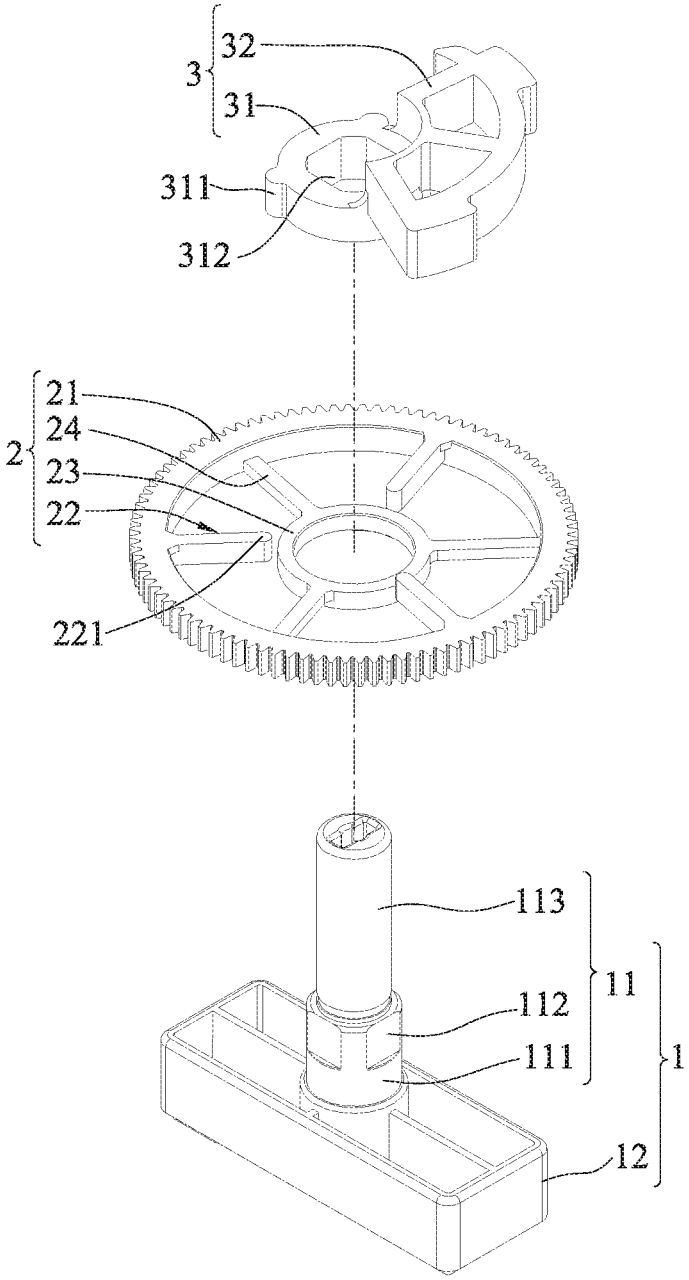
FIG. 1*a* is an exploded diagram of a transmission structure for an electronic lock of a first embodiment according to the present disclosure.
Figure 1B:
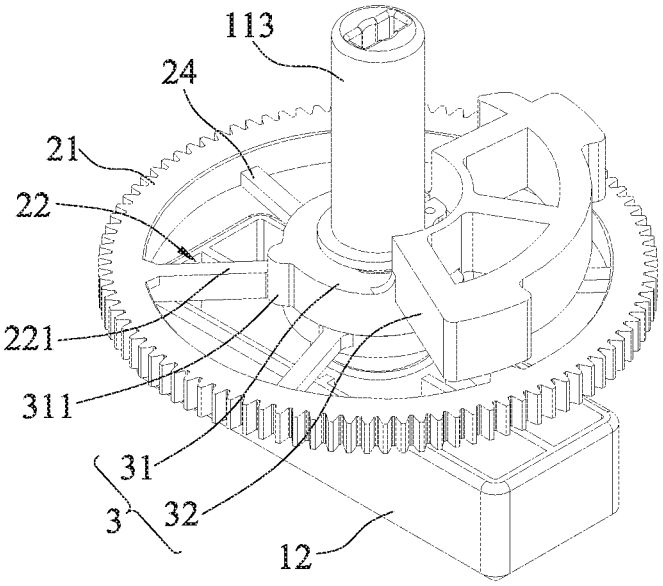
FIG. 1*b* is a perspective diagram of the transmission structure for the electronic lock of the first embodiment according to the present disclosure.

FIGS. 1*a* and 1*b* are an exploded diagram and a perspective diagram of a transmission structure for an electronic lock of a first embodiment according to the present disclosure, respectively. The transmission structure for an electronic lock comprises a turn button 1, a driven wheel 2 and an actuating member 3.

The turn button 1 includes a rotating shaft 11 and a handle 12 connected to the rotating shaft 11. The turn button 1 moves with a latch of a door latch unit (not shown) through the rotating shaft 11. In an embodiment, the rotating shaft 11 comprises a cylindrical axis part 111, a linkage part 112 engaged with the actuating member 3, and an extension part 113 moves with the latch. The rotating shaft 11 moves with the latch through the extension part 113. A user can open or close the latch manually by rotating the handle 12.

The driven wheel 2 is rotatably, axially disposed on rotating shaft 11. The driven wheel 2 includes a wheel body 21 and a plurality of connecting parts 22 disposed in the wheel body 21. In an embodiment, the driven wheel 2 has three connecting parts 22, as shown in FIG. 1*a*. Each of the connecting parts 22 has one end fixed to an inner wall of the wheel body 21, and the other end formed as a free end 221. Each of the connecting parts 22 is disposed along a radial direction of the wheel body 21. In an embodiment, the driven wheel 2 further comprises a coil 23 and a plurality of supporting members 24. Each of the supporting members 24 has two ends connected to an outer side of the coil 23 and the inner wall of the wheel body 21, respectively. The coil 23 is positioned in a center of the driven wheel 2, and rotatably, axially disposed on the axis part 111 of the rotating shaft 11. The driven wheel 2 can rotate about the axis part 111 under an external force (or a power). The driven wheel 2, when rotating, does not drive the rotating shaft 11 directly.

The actuating member 3 is axially disposed on the rotating shaft 11, and comprises a cam 31 and a pressing block 32 integrated with the cam 31. A plurality of abutting parts 311 are disposed on a circumference surface of the cam 31. In an embodiment, the cam 31 has three abutting parts 311, a noncircular through hole 312 is formed in a center of the cam 31 of the actuating member 3 and is conformal to the linkage part 112 of the rotating shaft 11 (i.e., the linkage part 112 and the through hole 312 have matched shapes), and the actuating member 3 is axially disposed on the linkage part 112. In another embodiment, the through hole 312 is a rectangular hole having round angles, and the linkage part 112 is a rectangular pillar having round angles.

Figure 2:
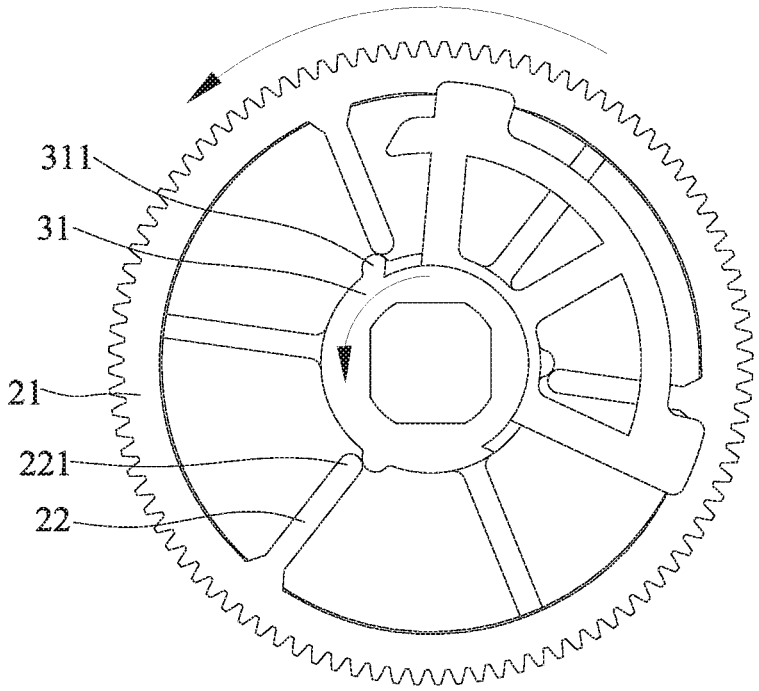
FIG. 2 is a schematic diagram illustrating how a driven wheel moves with an actuating member of the first embodiment according to the present disclosure.

Refer to FIG. 2, which illustrates that in a transmission structure for an electronic lock according to the present disclosure, when the driven wheel 2 rotates under external force, each of the free ends 221 abuts against a corresponding one of the abutting parts 311. Since the through hole 312 and the linkage part 112 are noncircular and have matched shapes, when the actuating member 3 moves with the rotating shaft 11, the latch connected to the rotating shaft 11 can displace between an unlocked position and a locked position. In a normal operation, the driven wheel 2 drives the actuating member 3, the actuating member 3 moves with the rotating shaft 11, and the latch can be locked or unlocked.

As described in the Description of the Prior Art, the latch cannot displace between the unlocked position and the locked position because a lock hole along which the latch moves is old or crooked, and the electronic lock will operate abnormally. The present disclosure provides a resolution to solve the problem.

When the latch cannot displace and the actuating member 3, as a result, cannot rotate, the driven wheel 2 keeps on rotating because the latch cannot in place. Since the rotating shaft 11 cannot rotate (i.e. the latch is stuck), the actuating member 3 cannot be driven by the driven wheel 2. Therefore, since the driven wheel 2 keeps on rotating, the latch cannot displace, and the actuating member 3 cannot drive the rotating shaft 11, the electronic lock will operate abnormally. The connecting parts 22 according to the present disclosure are elastic. Under a circumstance that the driven wheel 2 is applied with an external force, the free end 221 of each of the connecting parts 22 keeps on abutting against a corresponding one of the abutting parts 311 and is curved elastically, until the free end 221 spans across the abutting part 311. Finally, the connecting parts 22 will resume to their original noncurved state. Therefore, the situation that the free ends 221 of the connecting parts 22 push against the abutting parts 311 while the abutting parts 311 cannot move will not occur. After the free ends 221 of the connecting parts 22 span across the abutting parts 311, the free ends 221 do not abut against the abutting parts 311 any longer, and the connecting parts 22 will resume to their original state.

It is known from the above that in the electronic lock architecture according to the prior art, if the latch does not arrive at the unlocked position or the locked position, the entire transmission mechanism will not stop. Therefore, if an abnormal operation occurs, the transmission mechanism will still operate. In addition, when the actuating member 3 does not arrive at a specific position, a user cannot unlock the door lock by rotating the handle 12 manually if the electronic lock operates abnormally. The elastic connecting parts 22 according to the present disclosure can overcome the above problems. The specific position of the actuating member 3 will be described in the following paragraphs.

Figure 3A:
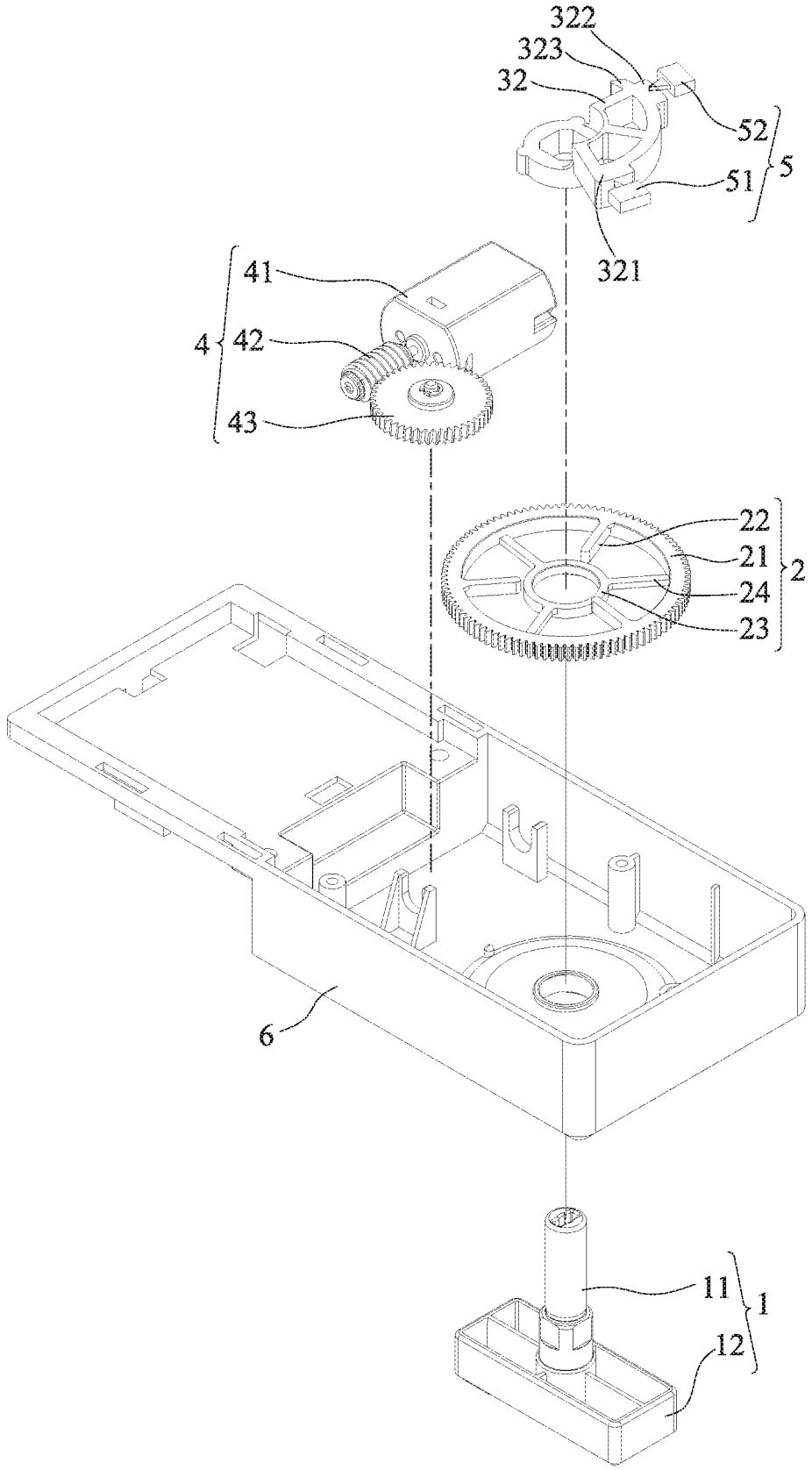
FIG. 3*a* is an exploded diagram of an overall structure of the transmission structure for the electronic lock of the first embodiment according to the present disclosure.
Figure 3B:
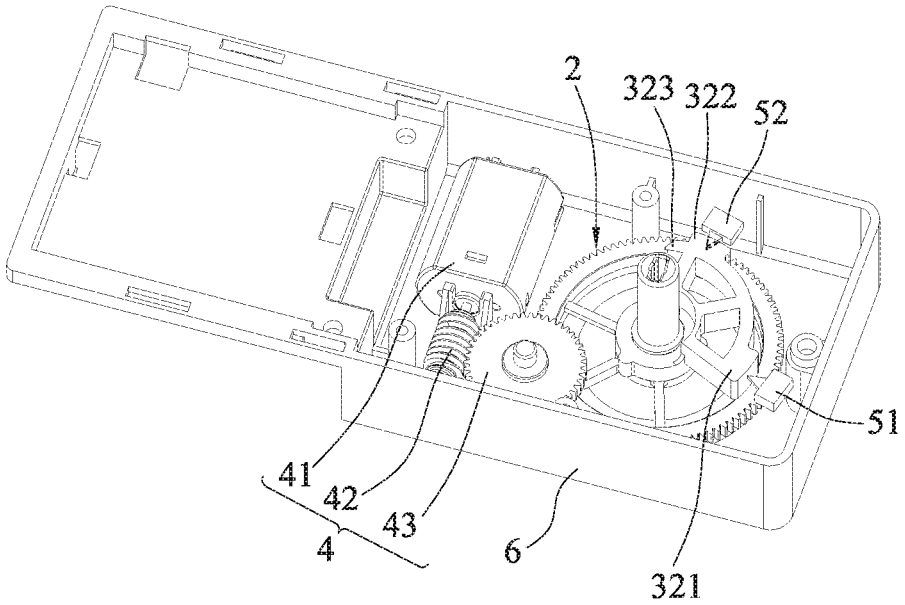
FIG. 3*b* is a perspective diagram of the overall structure of the transmission structure for the electronic lock of the first embodiment according to the present disclosure.

FIGS. 3*a* and 3*b* are an exploded diagram and a perspective diagram of an overall structure of the transmission structure for the electronic lock of the first embodiment according to the present disclosure, respectively. The transmission structure for an electronic lock further comprises a driving device 4 that provides power to rotate the driven wheel 2 and a switching device 5 electrically connected to the driving device 4.

The switching device 5 corresponds in position to the pressing block 32, and determines whether the actuating member 3 arrives at the specific position after sensing the position changing of the pressing block 32. The sensing result of the switching device 5 is a basis for the driving device 4 to drive the driven wheel 2. The pressing block 32 abuts against the switching device 5 in an initial position. When the driving device 4 rotates the driven wheel 2 and drives the actuating member 3, the pressing block 32 moves away from the initial position (due to the rotation of the actuating member 3), and does not abut against the switching device 5. When the pressing block 32 moves to another position with the rotation of the actuating member 3 and abuts against the switching device 5 again, the switching device 5 can sense the movement of the pressing block 32, which is used as a basis for operation of the driving device 4.

The transmission structure for an electronic lock further comprises a housing 6 that receives the driving device 4, the driven wheel 2, the actuating member 3 and the switching device 5. The rotating shaft 11 penetrates the housing 6. The handle 12 is disposed outside the housing 6.

Figure 4A:
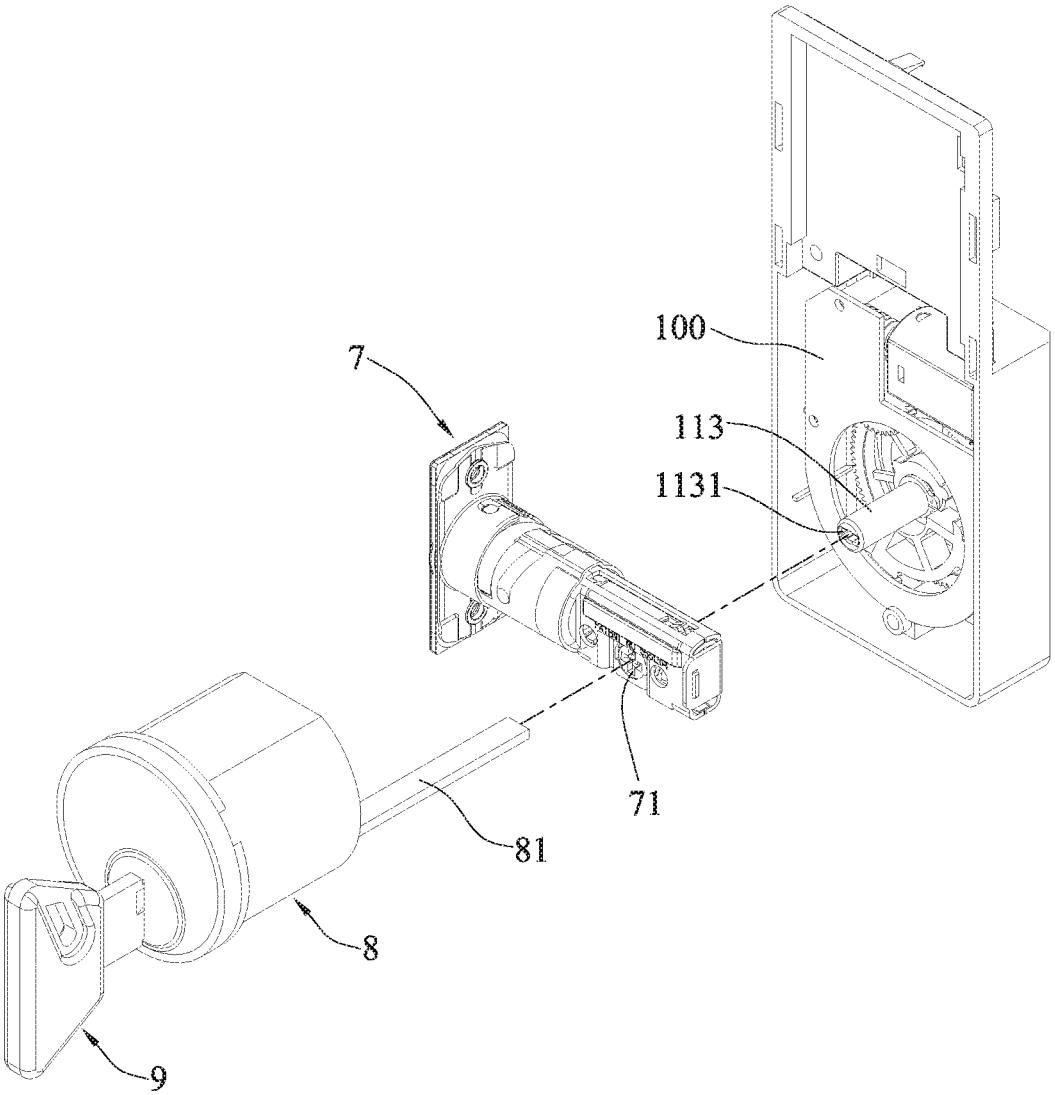
FIG. 4*a* is an exploded diagram of a transmission structure, a door latch unit and a lock set for an electronic lock according to the present disclosure.
Figure 4B:
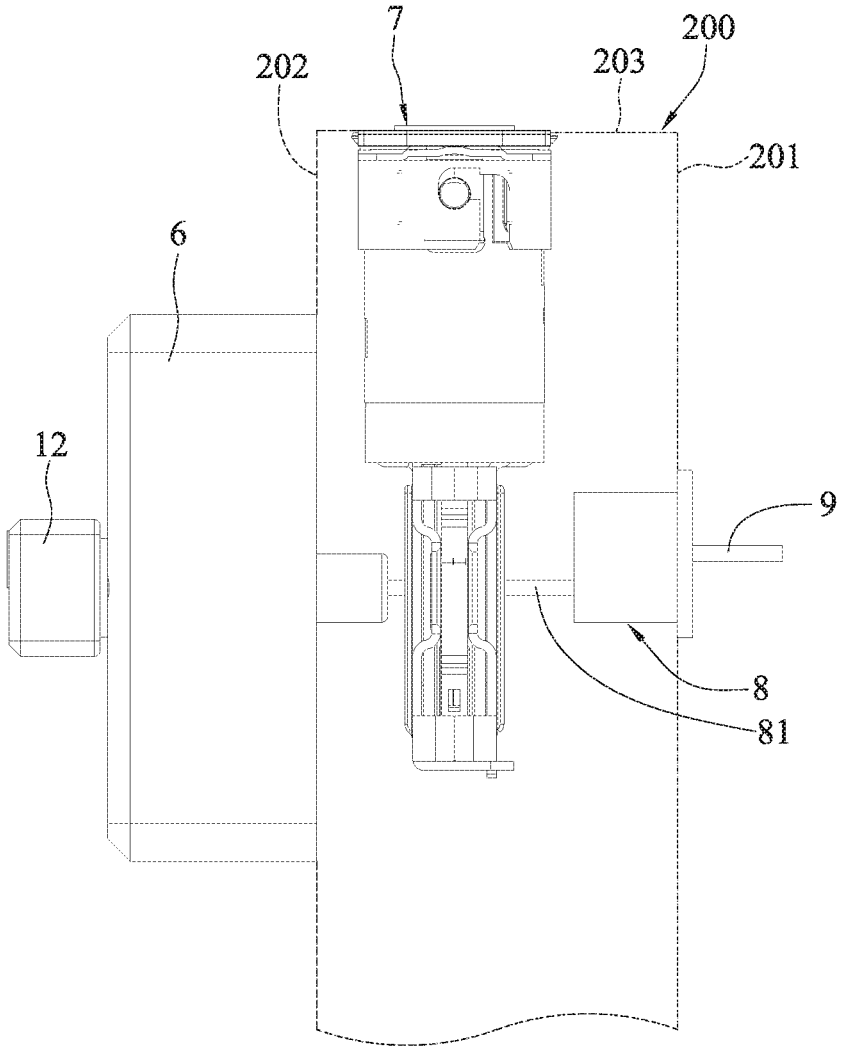
FIG. 4*b* is a schematic diagram of a transmission structure for an electronic lock assembled to a door according to the present disclosure.

FIG. 4*a* is an exploded diagram of a transmission structure, a door latch unit and a lock set for an electronic lock according to the present disclosure. FIG. 4*b* is a schematic diagram of a transmission structure for an electronic lock assembled to a door according to the present disclosure. Also refer to FIG. 1. The transmission structure for an electronic lock according to the present disclosure further comprises a printed circuit board 100. The switching device 5 can be disposed on the printed circuit board 100 to control the operation of the driving device 4. The transmission structure for an electronic lock according to the present disclosure is applied to a door latch unit 7 and a lock set 8. The lock set 8 and the housing 6 that receives the transmission structure for an electronic lock are disposed on an outer surface 201 and an inner surface 202 of a door 200, respectively. The door latch unit 7 is disposed on a lateral surface 203 of the door 200 corresponding to a lock hole. The lock set 8 allows a key 9 to be inserted therein to unlock or lock the lock set 8, and has a driven plate 81 extending toward the rotating shaft 11. The driven plate 81 penetrates a turning hole 71 of the door latch unit 7, enters a connecting hole 1131 of the extension part 113 of the rotating shaft 11, and is connected to the rotating shaft 11. When the key 9 unlocks or locks the lock set 8, the driven plate 81 moves with the latch and the turn button 1. When the key 9 unlocks the lock set 8, the driven plate 81 is rotated by the key 9 and turns the turning hole 71 to allow the latch to be retracted into the door latch unit 7 to be in the unlocked state. When the key 9 locks the lock set 8, the key 9 rotates the driven plate 81 to turn the turning hole 71, allowing the latch to protrude outward and be in the locked state.

Refer to FIGS. 1*a*, 3*a* and 3*b* again. In an embodiment, the wheel body 21 of the driven wheel 2 is a gear. The driving device 4 may comprise a motor 41, a worm 42 connected to the motor 41, and a driving wheel 43 having a gear wheel and a pinion that are axially disposed, integrated with each other, and engaged with the worm 42 and the wheel body 21, respectively, to transmit power between the motor 41 and the driven wheel 2. When the motor 41 is actuated, the gear wheel of the driving wheel 43 is driven by the worm 42 and rotates, the gear wheel and the pinion rotate synchronously to enable the driven wheel 2 to start to rotate, and the driven wheel 2 drives the actuating member 3.

If the actuating member 3 does not arrive at the specific position, the electronic lock operates abnormally and can be detected by the following mechanisms. The pressing block 32 of the actuating member 3 comprises a first protrusion 321 and a second protrusion 322. The switching device 5 comprises a first switch 51 and a second switch 52 corresponding in position to the first protrusion 321 and the second protrusion 322, respectively. In an embodiment, an included angle between an axis center of the rotating shaft 11 to the first switch 51 and the second switch 52 is about 90 degrees. The switching device 5 can drive the driving device 4 based on the relative positions of first protrusion 321 and the second protrusion 322 to the first switch 51 and the second switch 52, respectively. When the pressing block 32 is in an initial position, the first protrusion 321 and the second protrusion 322 abut the first switch 51 and the second switch 52, respectively and concurrently. When the driving device 4 rotates the driven wheel 2 to drive the actuating member 3, the first protrusion 321 and the second protrusion 322 do not abut against the first switch 51 and the second switch 52, respectively. With the rotation of the actuating member 3, the pressing block 32 rotates to another position, where only the first protrusion 321 abuts against the second switch 52, and the switching device 5 will get to know whether the actuating member 3 arrives at the specific position by sensing the positions of the first protrusion 321 and the second protrusion 322. Therefore, the driving device 4 can perform corresponding actions based on the sensing result of the switching device 5.

Figure 5:
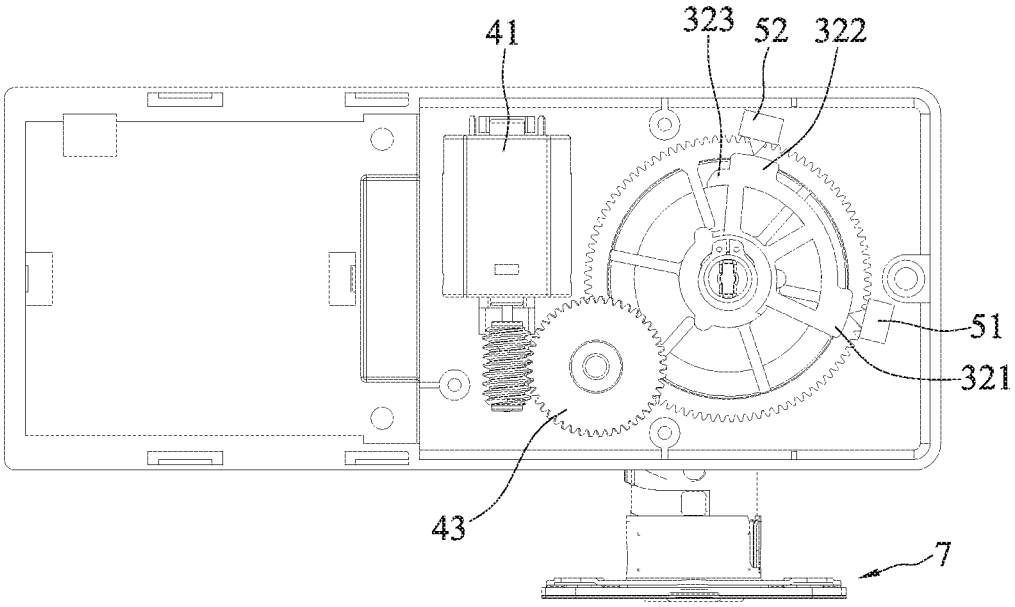
FIG. 5 is a schematic diagram of a transmission structure for an electronic lock in an unlocked state according to the present disclosure.
Figure 6:
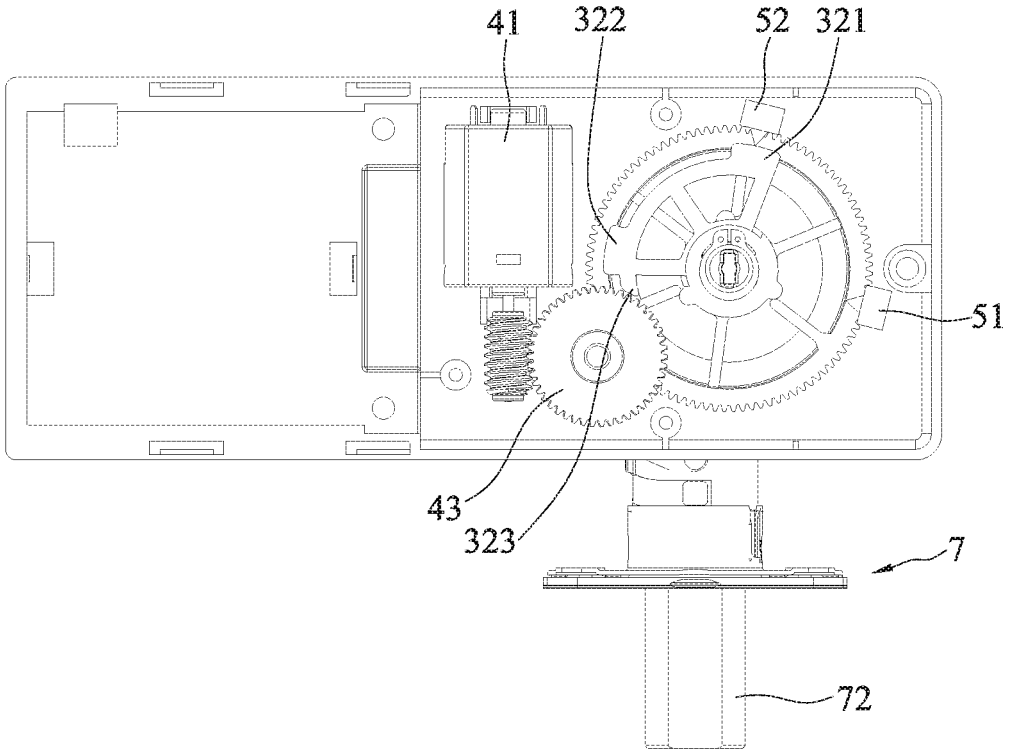
FIG. 6 is a schematic diagram of a transmission structure for an electronic lock in a locked state according to the present disclosure.

FIGS. 5 and 6 are schematic diagrams of a transmission structure for an electronic lock in an unlocked state and in a locked state according to the present disclosure, respectively. The present disclosure can be applied to a door lock of a door that is opened leftward or rightward. In an embodiment, the present disclosure is applied to a door lock of a door that is opened rightward. As shown in FIG. 5 and FIG. 3*a*, the pressing block 32 is in an unlocked position, and the latch is retracted. When a user is locking the door, the driving device 4 drives the driven wheel 2 to rotate, the driven wheel 2 rotates counterclockwise, the free ends 221 of the driven wheel 2 abut against the abutting parts 311 of the actuating member 3 to drive the actuating member 3 to rotate, the latch (which is retracted in the door latch unit 7) protrudes outward gradually, and the first protrusion 321 and the second protrusion 322 of the pressing block 32 move away from the first switch 51 and the second switch 52, respectively.

As shown in FIG. 6, after the pressing block 32 rotates counterclockwise and the first protrusion 321 abuts the second switch 52, the switching device 5 senses from that both the first switch 51 and the second switch 52 are abutted initially to that only the second switch 52 is abutted now, and can determine that the actuating member 3 rotates to a position where the latch 72 is in the locked position. The driving device 4 may then stop rotating based on the sensing result of the switching device 5. At the same time, the latch 72 protrudes to the locked position and the door is locked.

When the user is unlocking the door, the driving device enables the driven wheel 2 to rotate clockwise, and the first protrusion 321 and the second protrusion 322 return to their initial positions and abut the first switch 51 and the second switch 52, respectively and concurrently. Which is, the switching device 5 senses from that only the second switch 52 is abutted initially to that both the first switch 51 and the second switch 52 are abutted now, and can thus determine that the actuating member 3 has rotated to a position where the latch is in the unlocked position. At the same time, the latch 72 will retract simultaneously. In the process of opening the door from FIG. 6 back to FIG. 5, the free ends 221 of the driven wheel 2 move from the abutting parts 311 that they abut to initially to another abutting parts 311 (i.e. rotate along with the driven wheel 2) to drive the actuating member 3 to rotate again.

Refer to FIG. 6 and FIG. 3*a*. In an embodiment, where the door is opened rightward. As the motor 41 is not actuated, the first protrusion 321, which should stop at the second switch 52, keeps on going beyond the position of the second switch 52 due to its inertia, which results that the first protrusion 321 does not keep on pressing the second switch 52 and thus the motor 41 restarts and cannot be stopped. To solve the problem, the pressing block 32 of the actuating member 3 according to the present disclosure may further comprise a third protrusion 323. The third protrusion 323 is disposed on a side of the second protrusion 322 opposing the first protrusion 321. When the first protrusion 321 presses against the second switch 52, the third protrusion 323 abuts against an outer side of the gear wheel of the driving wheel 43, allowing the actuating member 3 to stop rotating and the first protrusion 321 to stay in a position corresponding to the second switch 52. The third protrusion 323 has an inclined surface corresponding to the driving wheel 43, to prevent the third protrusion 323 from being hooked to the driving wheel 43. In an embodiment that the door is opened leftward, the third protrusion is disposed on a side of the first protrusion opposing the second protrusion. The doors being opened leftward and rightward have similar operations, and differ only in that the driven wheel 2 as to the door being opened leftward drives the actuating member 3 to rotate in a direction opposing a direction along which the driven wheel 2 as to the door being opened rightward to rotate the actuating member 3, description of the operation thereof hereby omitted.

Figure 7A:
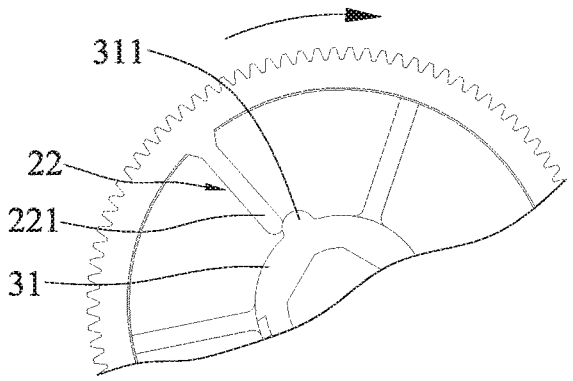
FIGS. 7*a* to 7*c* are schematic diagrams illustrating how free ends and abutting parts vary if a latch cannot displace in the first embodiment according to the present disclosure.
Figure 7B:
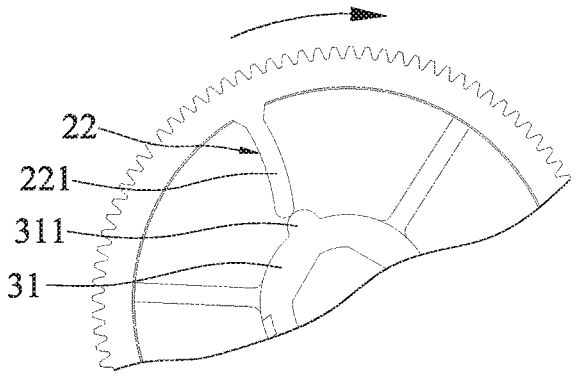
Figure 7C:
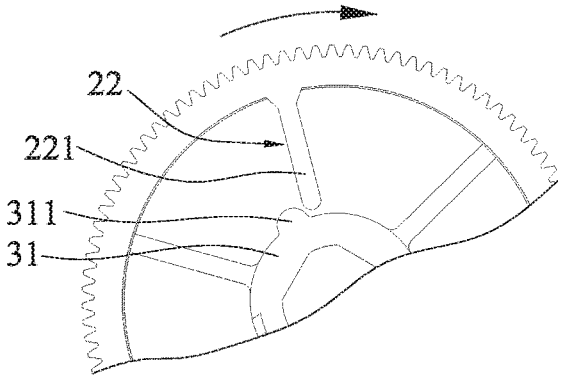

FIGS. 7*a*-7*c* are schematic diagrams illustrating how free ends and abutting parts vary if a latch cannot displace according to the present disclosure. Refer also to FIGS. 4-6. In an embodiment that the door is going to be locked, when the latch of the electronic lock cannot move to the locked position, such as when the latch is entering the corresponding lock hole (not shown) on the door, is blocked by a foreign object within the lock hole and cannot protrude entirely, the rotating shaft 11 and the actuating member 3 moving with the latch also cannot keep on rotating, which results that the first protrusion 321 of the pressing block 32 cannot arrive at the second switch 52 and the motor 41 keeps on operating and rotating the driven wheel 2. Accordingly, the free ends 221 will keep on abutting against the abutting parts 311 that are blocked and stopped. Since the connecting parts 22 are elastic, the above pushing and abutting movements will cause the connecting parts 22 to be curved elastically. The free ends 221 will displace and eventually span across the abutting parts 311 due to the elastic curving of the connecting parts 22. After the free ends 221 span across the abutting parts 311, the free ends 221 will resume to their initial noncurved state. In other words, at the time the free ends 221 will rotate idly. Therefore, according to the present disclosure, when the latch cannot displace, the driven wheel 2 will not be hooked to the actuating member 3. At the same time, a user can rotate the turn button 1 manually or use a key to rotate the turn button 1 from the lock set of the outer side of the door to unlock the lock set. The problem that the user cannot access the electronic lock due to the failure is solved. The above processes are shown in FIGS. 7*a*-7*c* sequentially. The free ends 221 push and abut against the abutting parts 311 first, then the connecting parts 22 displace elastically, and finally the free ends 221 span across the abutting parts 311 to allow the connecting parts 22 to resume to their original shape.

Even though the above mechanism can prevent the driven wheel 2 from being locked to the actuating member 3, the motor 41 will keep on operating because the driven wheel 2 rotates idly and the actuating member 3 cannot arrive at a target position (the specific position). In an embodiment, the motor 41 is designed to stop automatically after a certain period of time. Therefore, after the driven wheel 2 rotates idly for a certain period of time, the motor stops and is protected. According to the present disclosure, when the electronic lock operates abnormally, a user can retreat the latch from the lock hole by merely rotating the turn button 1 manually, and then clear the foreign object in the lock hole, to eliminate the failure.

Figure 8:
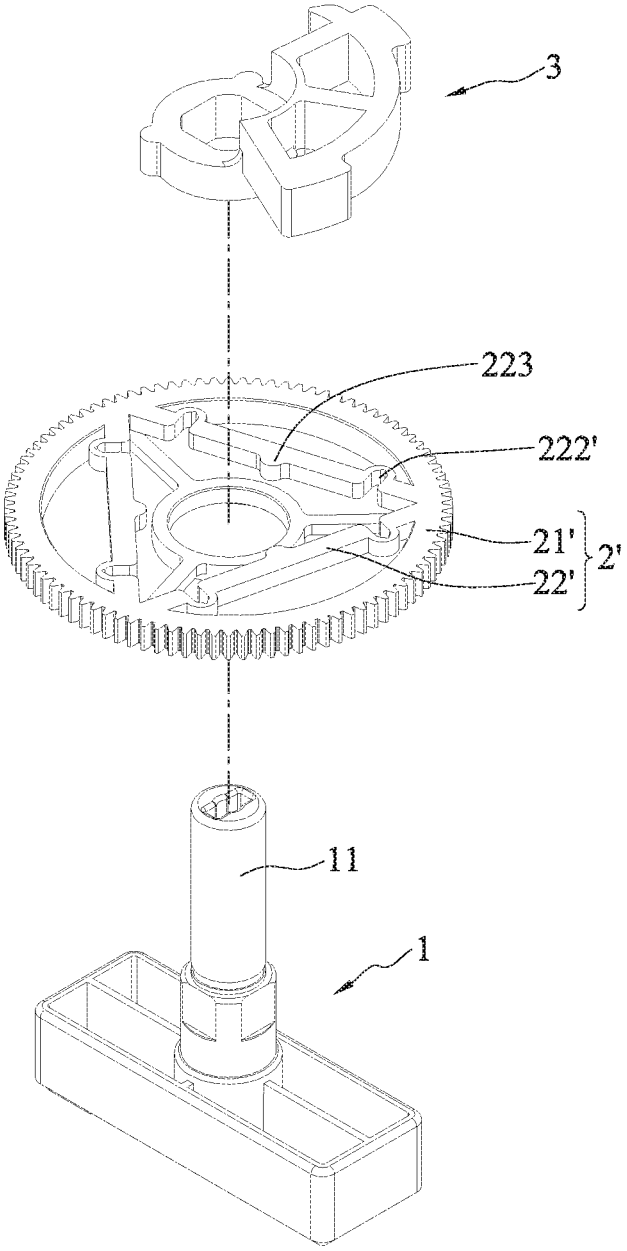
FIG. 8 is an exploded diagram of a transmission structure for an electronic lock of a second embodiment according to the present disclosure.

FIG. 8 is an exploded diagram of a transmission structure for an electronic lock of a second embodiment according to the present disclosure. The second embodiment differs from the first embodiment in that in the second embodiment, each of the connecting parts 22' of the driven wheel 2' has two ends fixed to the inner wall of the wheel body 21', and each of the connecting parts 22' has a pushing block 223 and at least one elastic structure 222'. In an embodiment, each of the connecting parts 22' has two elastic structures 222', and the pushing block 223 is disposed between the two elastic structure 222'. In an embodiment, the elastic structure 222' is, but not limited to, U-shaped. In another embodiment, three connecting parts 22' are connected to form a triangular structure, to strengthen the overall structure of the driven wheel 2'.

Figure 9:
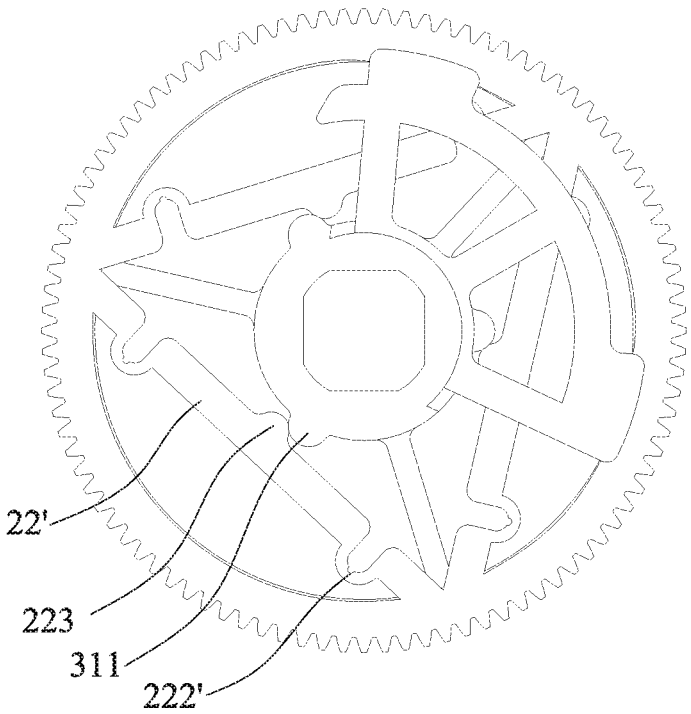
FIG. 9 is a schematic diagram illustrating how a driven wheel moves with an actuating member of the second embodiment according to the present disclosure.

FIG. 9 is a schematic diagram illustrating how a driven wheel moves with an actuating member of the second embodiment according to the present disclosure. When the driven wheel 2' rotates under external force, each of the pushing blocks 223 abuts against a corresponding one of the abutting parts 311 to enable the actuating member 3 to rotate. The actuating member 3 moves with the rotating shaft 11, and the latch connected to the rotating shaft 11 can displace between the unlocked position and the locked position. In an embodiment, the rotating shaft 11, the driven wheel 2' and the actuating member 3 have a similar relation to those in the first embodiment, further description thereof hereby omitted.

Figure 10A:
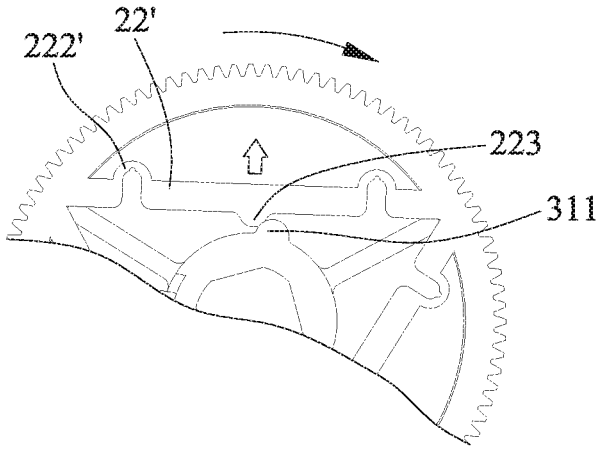
FIGS. 10*a* to 10*c* are schematic diagrams illustrating how pushing blocks and abutting parts vary if a latch cannot displace in the second embodiment according to the present disclosure.
Figure 10B:
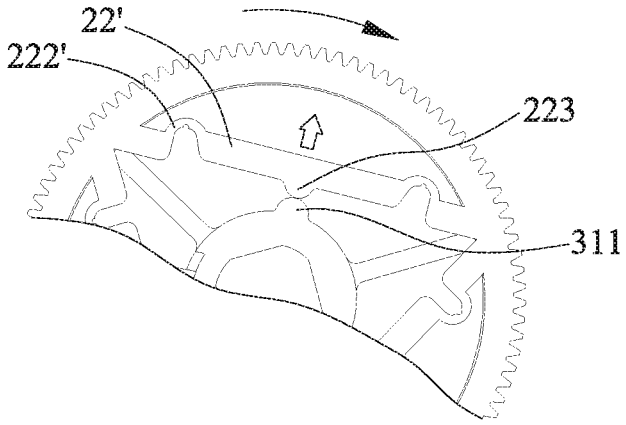
Figure 10C:
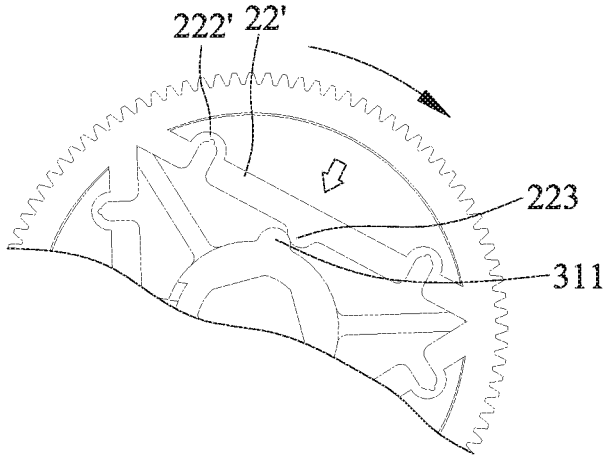

FIGS. 10*a*-10*c* are schematic diagrams illustrating how pushing blocks and abutting parts vary if a latch cannot displace in the second embodiment according to the present disclosure. Refer also to FIG. 9. In normal operation, the pushing blocks 223 abut against the abutting parts 311, as shown in FIG. 10*a*. When the latch cannot displace and the actuating member 3 cannot rotate, the at least one elastic structure 222' is deformed since the abutting parts 311 abut against the pushing blocks 223, and the connecting parts 22' displace elastically in a direction away from the abutting parts 311, as shown in FIG. 10*b*. Therefore, each of the pushing blocks 223 can span across a corresponding one of the abutting parts 311, and the connecting parts 22' will resume to their initial state, as shown in FIG. 10*c*. Therefore, when the lock hole is abnormal and the latch cannot protrude outward completely, the above structure allows the driven wheel 2' to rotate idly, to ensure that the driven wheel 2' can operate normally and protect the motor from being damaged even if the latch is hooked.

In another embodiment, the abutting parts 311 of the actuating member 3 are groove structures, and the pushing blocks 223 of the driven wheel 2' are protruding blocks that match the groove structures and can protrude into the groove structures. When the driven wheel 2' rotates, the pushing blocks 223 protrude into the groove structures, to enable the pushing blocks 223 to push the abutting parts 311. When the latch is hooked, the elastic design of the connecting parts 22' (e.g. the elastic structure of the second embodiment according to the present disclosure) can prevent the driven wheel 2' from being hooked to the actuating member 3. The above structures differ only in the designs of the pushing blocks 223 and the abutting parts 311. The structure design only requires that the pushing blocks 223 can push and abut the abutting parts 311 and the connecting parts 22' are elastic. Therefore, the driven wheel 2' can be prevented from being hooked to the actuating member 3.

In the transmission structure for an electronic lock according to the present disclosure, the driven wheel moves with the free ends or the pushing blocks of the connecting parts to abut against the abutting parts of the actuating member to drive the actuating member and to drive the rotating shaft and the latch that move with the actuating member. According to the present disclosure, the connecting parts are elastic, and the free ends or the pushing blocks can span across the abutting parts and keep on rotating idly when the latch cannot displace. Therefore, the problem that the driven wheel is hooked with the actuating member while the motor is still operating can be solved. A user can then rotate the turn button manually to open the door, and eliminate the failure after the door is unlocked.

The foregoing descriptions of the detailed embodiments are only illustrated to disclose the features and functions of the present disclosure and not restrictive of the scope of the present disclosure. It should be understood to those in the art that all modifications and variations according to the spirit and principle in the disclosure of the present disclosure should fall within the scope of the appended claims.

What is claimed is:

1. A transmission structure for an electronic lock, comprising:

a turn button having a rotating shaft;

a driven wheel rotatably, axially disposed on the rotating shaft and including a wheel body and a plurality of connecting parts disposed in the wheel body, each of the connecting parts having one end fixed to an inner wall of the wheel body and the other end formed as a free end; and an actuating member axially disposed on the rotating shaft and including a cam, a pressing block disposed on the cam, and a plurality of abutting parts disposed on a circumference surface of the cam, wherein when the driven wheel is driven by a power to rotate, each of the free ends abuts against a corresponding one of the abutting parts, the actuating member moves with the rotating shaft, and a latch connected to the rotating shaft displaces between an unlocked position and a locked position, and wherein when the driven wheel is driven by a power to rotate, the latch does not displace and the actuating member cannot rotate, each of the free ends is still abutted by the corresponding one of the abutting parts and each of the connecting parts is curved elastically until the free end spans across the corresponding one of the abutting parts.

2. The transmission structure of claim 1, wherein the driven wheel further comprises a coil rotatably, axially disposed on the rotating shaft and a plurality of supporting members, each of the supporting members having two ends connected to an outer side of the coil and the inner wall of the wheel body, respectively.

3. The transmission structure of claim 1, further comprising:

a switching device corresponding in position to the pressing block and configured for sensing a position changing of the pressing block; and a driving device electrically connected to the switching device and configured for providing the power to rotate the driven wheel based on the position changing of the pressing block.

4. The transmission structure of claim 3, wherein the pressing block comprises a first protrusion, a second protrusion, and a third protrusion, the switching device comprises a first switch and a second switch corresponding to the first protrusion and the second protrusion, respectively, and senses a first relative position of the first protrusion and the first switch and a second relative position of the second protrusion and the second switch, the driving device rotates the driven wheel based on the first relative position and the second relative position, and the third protrusion is disposed on a side of the first protrusion opposing the second protrusion or on a side of the second protrusion opposing the first protrusion.

5. The transmission structure of claim 3, wherein the driving device comprises a motor, a worm connected to the motor, and a driving wheel having a gear wheel and a pinion engaged with the worm and the wheel body, respectively, and when the motor is actuated, the worm drives the driving wheel to rotate the driven wheel.

6. The transmission structure of claim 3, further comprising a housing configured for receiving the driving device, the driven wheel, the actuating member and the switching device.

7. The transmission structure of claim 1, wherein each of the connecting parts is disposed along a radial direction of the wheel body.

8. The transmission structure of claim 1, which is applicable to a lock set that is locked or unlocked by a key and has a driven plate extending toward the rotating shaft, penetrating the latch, connected to an extension part of the rotating shaft, and configured for moving the latch and the turn button when the key locks or unlocks the lock set.

9. A transmission structure for an electronic lock, comprising:

a turn button having a rotating shaft;

a driven wheel rotatably, axially disposed on the rotating shaft and including a wheel body and a plurality of connecting parts disposed in the wheel body, each of the connecting parts having two ends fixed to an inner wall of the wheel body, a pushing block, and at least one elastic structure; and an actuating member axially disposed on the rotating shaft and including a cam, a pressing block disposed on the cam, and a plurality of abutting parts disposed on a circumference surface of the cam, wherein when the driven wheel is driven by a power to rotate, each of the pushing blocks abuts against a corresponding one of the abutting parts, the actuating member moves with the rotating shaft, and a latch connected to the rotating shaft displaces between an unlocked position and a locked position, and wherein when the driven wheel is driven by a power to rotate, the latch does not displace and the actuating member cannot rotate, each of the pushing blocks is still abutted by the corresponding one of the abutting parts and the at least one elastic structure is deformed until the pushing blocks span across the corresponding one of the abutting parts.

10. The transmission structure of claim 9, wherein the at least one elastic structure is U-shaped.

11. The transmission structure of claim 9, wherein the plurality of connecting parts form a triangular structure.

12. The transmission structure of claim 9, wherein the driven wheel further includes a coil rotatably, axially disposed on the rotating shaft and a plurality of supporting members, each of the supporting members having two ends connected to an outer side of the coil and an inner wall of the wheel body, respectively.

13. The transmission structure of claim 9, further comprising:

a switching device corresponding in position to the pressing block and configured for sensing a position changing of the pressing block; and a driving device electrically connected to the switching device and configured for providing the power to rotate the driven wheel based on the position changing of the pressing block.

14. The transmission structure of claim 13, wherein the pressing block comprises a first protrusion, a second protrusion, and a third protrusion, the switching device comprises a first switch and a second switch corresponding to the first protrusion and the second protrusion, respectively, and senses a first relative position of the first protrusion and the first switch and a second relative position of the second protrusion and the second switch, the driving device rotates the driven wheel based on the first relative position and the second relative position, and the third protrusion is disposed on a side of the first protrusion opposing the second protrusion or on a side of the second protrusion opposing the first protrusion.

15. The transmission structure of claim 13, wherein the driving device comprises a motor, a worm connected to the motor, and a driving wheel having a gear wheel and a pinion engaged with the worm and the wheel body, respectively, and when the motor is actuated, the worm drives the driving wheel to rotate the driven wheel.

16. The transmission structure of claim 13, further comprising a housing configured for receiving the driving device, the driven wheel, the actuating member and the switching device.

17. The transmission structure of claim 9, which is applicable to a lock set that is locked or unlocked by a key and has a driven plate extending toward the rotating shaft, penetrating the latch, connected to an extension part of the rotating shaft, and configured for moving the latch and the turn button when the key locks or unlocks the lock set.

* * * * *